United States Patent [19]

Vakil

[11] 4,304,099

[45] Dec. 8, 1981

[54] MEANS AND METHOD FOR THE RECOVERY OF EXPANSION WORK IN A VAPOR COMPRESSION CYCLE DEVICE

[75] Inventor: Himanshu B. Vakil, Schenectady, N.Y.

[73] Assignee: General Electric Company, Schenectady, N.Y.

[21] Appl. No.: 114,962

[22] Filed: Jan. 24, 1980

[51] Int. Cl.[3] ..... F25D 9/00

[52] U.S. Cl. ..... 62/86; 62/114; 62/511; 62/527

[58] Field of Search ..... 62/511, 527, 114, 86

[56] References Cited

U.S. PATENT DOCUMENTS

| | | | |
|---|---|---|---|
| 2,687,626 | 8/1954 | Bartlowe | 62/511 |
| 2,785,542 | 3/1957 | Thomas | 62/511 |
| 2,956,421 | 10/1960 | Stevens | 62/511 |
| 2,979,924 | 4/1961 | Balogh | 62/511 |
| 3,048,021 | 8/1962 | Coles et al. | 62/511 |
| 3,172,272 | 3/1965 | Alsing | 62/511 |
| 3,872,682 | 3/1975 | Shook | 62/114 |
| 4,086,782 | 5/1978 | Forsberg | 62/511 |

OTHER PUBLICATIONS

Stoecker, W. F., Improving the Energy Effectiveness of Domestic Refrigerators by the Application of Refrig. Mixtures U.S.D.O.E. ORNL/Sub-78/55463/1, pp. 39-47.

Burr, P. S. et al., "A Non-Isothermal Mixed Refrigerant Cycle for Air Conditioning Duties", 1974, Institute of Refrigeration at the Polytechnic of the South Bank, London.

*Primary Examiner*—Ronald C. Capossela

*Attorney, Agent, or Firm*—Paul R. Webb, II; James C. Davis, Jr.

[57] ABSTRACT

Recovery of substantially all of the work associated with the expansion of a multi-component working fluid mixture in a vapor compression cycle device is enabled by conveying working fluid in a liquid phase from a condenser to a coldest portion of an evaporator assembly in a countercurrent heat exchange relationship with fluid flowing through the evaporator assembly.

13 Claims, 4 Drawing Figures

MEANS AND METHOD FOR THE RECOVERY OF EXPANSION WORK IN A VAPOR COMPRESSION CYCLE DEVICE

BACKGROUND OF THE INVENTION

This invention relates generally to an improvement in vapor compression cycle device performance, and more particularly, to a means and a method for the recovery of thermodynamic work of expansion in such a device.

In the thermodynamic cycle of a conventional vapor compression cycle device, working fluid is compressed, condensed, expanded and evaporated. Expansion of the fluid is typically accomplished through the irreversible process of flashing, which can be a source of cycle inefficiency in that available thermodynamic work of expansion ($\rho VdP$) is not recovered. The present invention is intended to better recover this expansion work, thereby improving the cycle efficiency.

Most earlier attempts to recover this expansion work involved its conversion into mechanical work. These attempts may be typified by U.S. Pat. No. 4,170,116 (Williams) in which a flow of working fluid to be expanded is apparently intended to be employed in the rotation of a shaft.

In contrast, the present invention is intended to improve the thermodynamic efficiency of a device. Depending upon the application, this improved efficiency may be exhibited in two forms. In a first type of application in which there is a relatively constant operating temperature range as in a refrigerator, the practice of the present invention will result in a decrease in the compressor power required to provide a given amount of cooling. This is achieved by increasing the evaporator pressure, thereby also increasing the compressor suction pressure. In a second type of application in which there is a variable operating temperature range as in a heat pump, the practice of the present invention will enable the "pumping" of heat across a greater temperature range for a given amount of compressor work. Thus, in either application the resultant thermodynamic cycle efficiency is improved.

Certain refrigeration cycle designs currently improve their thermodynamic efficiency by recovering a portion of the available expansion work through a transfer of heat from expanding working fluid flowing in a capillary tube to vapor flowing in a compressor suction line resulting in a superheating of the vapor. However, only a relatively small portion of the available expansion work is recovered in such a device.

A device in which a portion of the available expansion work is apparently recovered by heat exchange with working fluid undergoing evaporation is described by W. F. Stoecker in "Improving the Energy Effectiveness of Domestic Refrigerators by the Application of Refrigerant Mixtures" U.S. Dept. of Energy Publ. ORNL/Sub-78/55463/1. The device described by Stoecker includes two discrete countercurrent heat exchangers disposed in a multicomponent working fluid flow path after a low temperature evaporator section and separated by a relatively high temperature evaporator section of the device. Working fluid is caused to flow from a device condenser through the two countercurrent heat exchangers prior to being flashed into at least a partial vapor phase conveyed to the lower temperature section of the evaporator. Thus, a portion of the available work of expansion is recovered through heat transfer in two separate heat exchangers operating across discrete elevated portions of the evaporator temperature range of a device.

As an example Stoecker describes a refrigerator application employing a 50% Freon-12/50% Freon-114 working fluid mixture in which the temperature range of the mixture while undergoing evaporation is approximately −20° F. to −2° F., with the external countercurrent heat exchangers operating approximately over the −12° F. to −10° F. and −5° F. to −2° F. portions of that range. The corresponding temperature drop for the working fluid liquid cooled in these two heat exchangers is approximately 90° F. to 28° F. and 28° F. to 2° F. respectively, with the fluid subsequently being flashed into at least a partial vapor phase at approximately −20° F. prior to entering the low temperature evaporator section. Accordingly, the portion of available work of expansion from 2° F. to −20° F. is not recovered. In particular, in the example cited by Stoecker a beneficial extraction of approximately 20 BTU/lb. of heat is accomplished from the liquid between 90° F. and 2° F. However, in this example there remains available but unrecovered the additional enthalphy from 2° F. to −22° F. from Stoecker given parameters.

Additionally, the effective cooling potential of the evaporator defined as the cooling potential available for use in cooling a fluid of interest, such as air in a refrigerator unit, is lost in the device described by Stoecker over the temperature ranges of −12° F. to −10° F. and −5° F. to −2° F. Furthermore, the device described by Stoecker exhibits a thermodynamically inefficient transfer of heat as exemplified by the above-noted use of −5° F. to −2° F. cooling potential to cool working fluid from 90° F. to 28° F.

Accordingly, it is an object of the present invention to enable the lowering of the average temperature at which the evaporator duty of a device is available.

Another object of the present invention is to enable an increase in the evaporator pressure, and thus the compressor suction pressure of a vapor compression cycle device.

Another object of the present invention is to provide a more thermodynamically efficient closer matching of device cooling potential with the temperatures of fluids to be cooled.

Another object of the present invention is to improve the performance of a vapor compression cycle device by enabling the recovery of the maximum available thermodynamic work of expansion in such a device for a given set of design parameters.

Still another object of the present invention is to provide a simplified device in which heat associated with the work of expansion is absorbed by working fluid being evaporated without a loss of the effective cooling potential of an evaporator over a given temperature range.

SUMMARY OF THE INVENTION

The above and other objects and advantages are achieved in a means and a method for the recovery of expansion work in a vapor compression cycle device employing a multiple component working fluid mixture in which a flow of mixture from a device condenser is conveyed to a coldest portion of an evaporator assembly while substantially in a liquid phase. The mixture is conveyed in a countercurrent heat exchange relationship with fluid flowing through at least a portion of a flow path in the evaporator assembly extending from the coldest portion towards a warmest portion of the assembly, and preferably in such a relationship with fluid flowing through substantially all of the evaporator assembly flow path. In a preferred embodiment expansion work is efficiently recovered by first conveying the mixture in a heat exchange relationship with vapor in a compressor suction line of the device. In a preferred means the mixture is conveyed in a capillary tube disposed in thermal contact with both the evaporator assembly and the compressor suction line.

BRIEF DESCRIPTION OF THE DRAWINGS

For a better understanding of the invention reference may be had to the accompanying drawing wherein.

DESCRIPTION OF THE INVENTION

To optimize the recovery of expansion work as characterized herein by increased thermodynamic efficiency, it is necessary to completely eliminate the formation of vapor during the expansion of the condensed fluid prior to its evaporation. This in turn requires that the condensed fluid be maintained at or below its bubble point temperature (also known as the liquid saturation temperature) throughout the expansion process. The present invention employs heat transfer from the condensed fluid to fluid undergoing evaporation to enable this maintenance of condensed fluid temperature. However, as noted hereinbelow, the present invention is not limited to this optimal case, but also includes situations in which a degradation of efficiency occurs through some vapor formation during fluid expansion. Additional thermodynamic efficiency is obtained in the present invention by minimizing the temperature mismatch between the two fluid flows during the transfer of heat.

Thus, in contrast to the device described by Stoecker noted hereinabove, the present invention provides for the extension of the countercurrent exchange of heat to the coolest portion of an evaporator assembly. As a result, the typically available but unrecovered expansion work characterized by a formation of vapor in working fluid mixture prior to its entry into an evaporator assembly may be substantially recovered through the practice of the invention by a potentially complete elimination of vapor formation. Accordingly, the flashing of the mixture from 2° F. to −20° F. in the example noted above is substantially eliminated by the present invention and the extraction of an additional 5 BTU/lb liquid of heat over that in the example noted above is enabled resulting in an increase in recovered expansion work.

Figure 1:
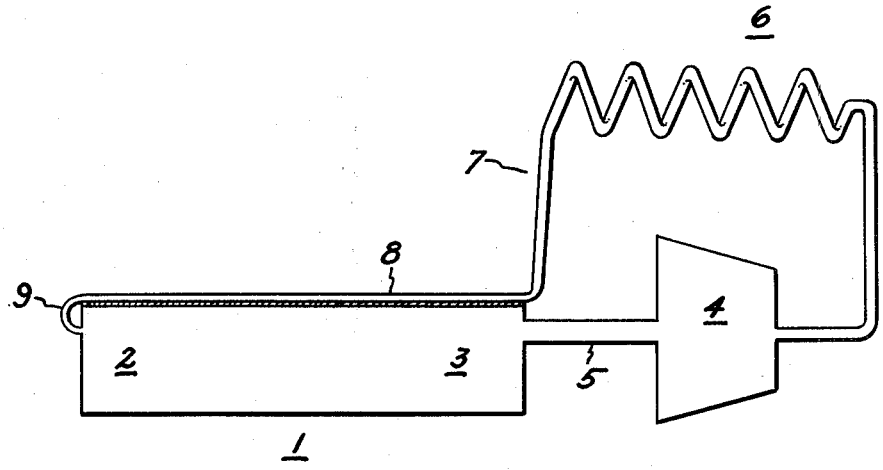
FIG. 1 is a schematic illustration of one embodiment of the invention.
Figure 2:
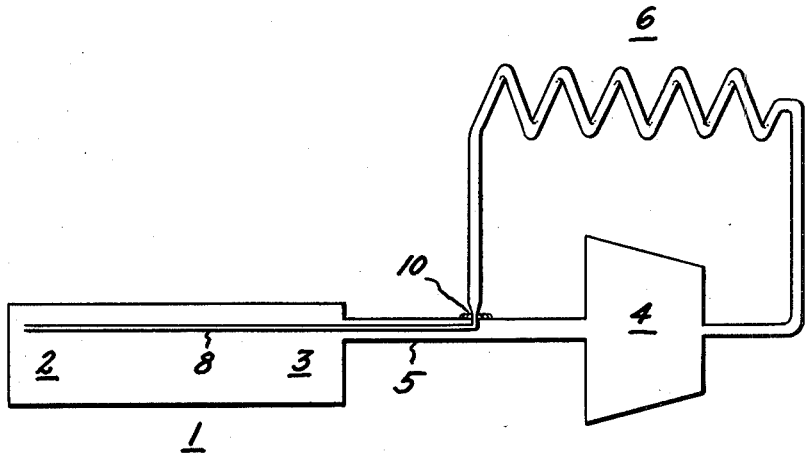
FIG. 2 is a schematic illustration of an alternative embodiment of the present invention.

Thus, in the embodiments of the invention depicted in FIGS. 1 and 2, a vapor compression device according to the present invention includes an evaporator assembly 1 having a working fluid flow path extending therethrough from a coldest portion 2 to the warmest portion 3 of the assembly 1. A compressor 4 is connected to an outlet of the evaporator assembly 1 adjacent the warmest portion 3 by a suction line 5. A compressor outlet is connected to a condensing heat exchanger 6. The outlet of the condensing heat exchanger 6 is connected to the coldest portion 2 of the assembly 1 by a means 7 including a heat transfer passage 8.

Although not limited thereby, the heat transfer passage 8 in the embodiments depicted in both FIGS. 1 and 2 comprises a suitable capillary tube. However, it is understood that in certain applications the heat transfer passage 8 may preferably be a conduit. In such an embodiment, a suitable flow restricting device is required and may be beneficially located in the conveying means 7 such as in that portion denoted by the numeral 9 in FIG. 1.

The heat transfer passage 8 is disposed in a countercurrent heat exchange relationship with respect to fluid flowing through the flow path in the evaporator assembly 1. Thus, in the embodiment depicted in FIG. 1 an external surface of the heat transfer passage 8 is placed in thermal contact with an external surface of the evaporator assembly 1. This thermal contact may be by direct physical contact as in FIG. 1 or may be by indirect contact through an intermediary material such as a layer of air. However, since the present invention is dependent upon the transfer of heat, it is obvious that efficiency gains realized by the practice of the present invention will increase with improved heat transfer between the heat transfer passage 8 and the fluid flowing through the evaporator assembly 1.

In the alternative embodiment depicted in FIG. 2, the heat transfer passage is disposed in a countercurrent heat exchange relationship within the flow path in the evaporator assembly 1. This embodiment may be preferable in those applications where contact between an aluminum evaporator assembly and the copper capillary tube is otherwise difficult to obtain. Instead, the capillary tube may enter the fluid flow path through the suction line 5 which is typically constructed of a material ameanable to sealing as with solder at a point of entry 10.

Figure 3:
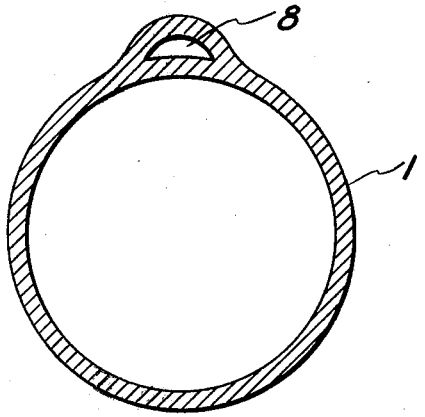
FIG. 3 is a cross-sectional view of an evaporator assembly and heat transfer passage of a device constructed according to another embodiment of the present invention.

In another embodiment of the present invention depicted in a partial cross-section in FIG. 3, a portion of the flow path in the evaporator assembly 1 and of the heat transfer passage 8 may be formed in a single monolithic heat exchange device in which the flow path and heat transfer passage are disposed in thermal contact on opposite sides of a common heat transfer wall. Such a device might be constructed by conventional manufacturing techniques as by co-extrusion.

In a preferred embodiment of the invention, the countercurrent heat exchange relationship of the heat transfer passage 8 with fluid flowing through the evaporator assembly 1 extends along substantially all of the flow path in the evaporator assembly from the coldest portion 2 to the warmest portion 3. This embodiment enables an averaging of the heat transfer across the entire temperature range of the evaporator assembly 1 such that no portion of the evaporator temperature range is made unavailable as in device described by Stoecker and noted hereinabove. However, it is understood that in certain applications such an averaging may not be desirable and the heat transfer may occur across a decreased portion of the evaporator temperature range provided at least a portion of heat transfer passage 8 is in countercurrent heat exchange relationship with a portion of the evaporator assembly flow path extending from the coldest portion towards but not necessarily to the warmest portion 3.

Similarly, in the preferred embodiment of the invention depicted in FIG. 2, the countercurrent exchange of heat from the fluid flowing through the heat transfer passage 8 is extended to the fluid flowing through the compressor suction line 5. This embodiment enables a thermodynamically more efficient recovery of expansion work through a closer temperature matching between the higher temperature mixture flowing into the suction line 5 and that flowing from the condensing heat exchanger 6 and through the heat transfer passage 8.

In operation a multiple component working fluid mixture is circulated in devices such as depicted in FIGS. 1 and 2. The working fluid mixture is miscible over the operating temperature range of the device and may include one of the following combinations; Freon-22 and -114; Freon-13Bl and 152A; or Freon-22, -23, and -114. Selection of mixture composition is dependent on specific design parameters. However, it is well-known that the selection of a mixture comprising components with more widely variant boiling points will extend the useful operating range of the evaporator assembly 1.

The selected mixture is evaporated in the assembly 1 and is conveyed through the suction line 5 to the compressor 4 where is compressed and becomes superheated. The mixture vapor now at an elevated temperature and pressure is then condensed in the condensing heat exchanger 6. A resulting working fluid condensate is conveyed by the means 7 from the condensing heat exchanger outlet to the coldest portion 2 of the evaporator assembly 1.

More specifically, the condensate is conveyed through a heat transfer passage 8. In the embodiments of FIGS. 1 and 2 in which the heat transfer passage 8 is a capillary both the temperature and pressure of the mixture are gradually decreased while flowing into a countercurrent heat exchange relationship with working fluid flowing through the flow path in the evaporator assembly 1.

Preferably, no vapor will be formed during the conveyance from the condensing heat exchanger to the evaporator assembly. However, it is appreciated that some vapor may form during this conveyance if insufficient heat exchange is provided, thereby degrading the efficiency of the present invention. Nonetheless, an efficiency gain will be experienced even in this less desirable case over the efficiency available with the device described by Stoecker since at least a portion of the available but unrecovered expansion work in that device will be recovered.

Figure 4:
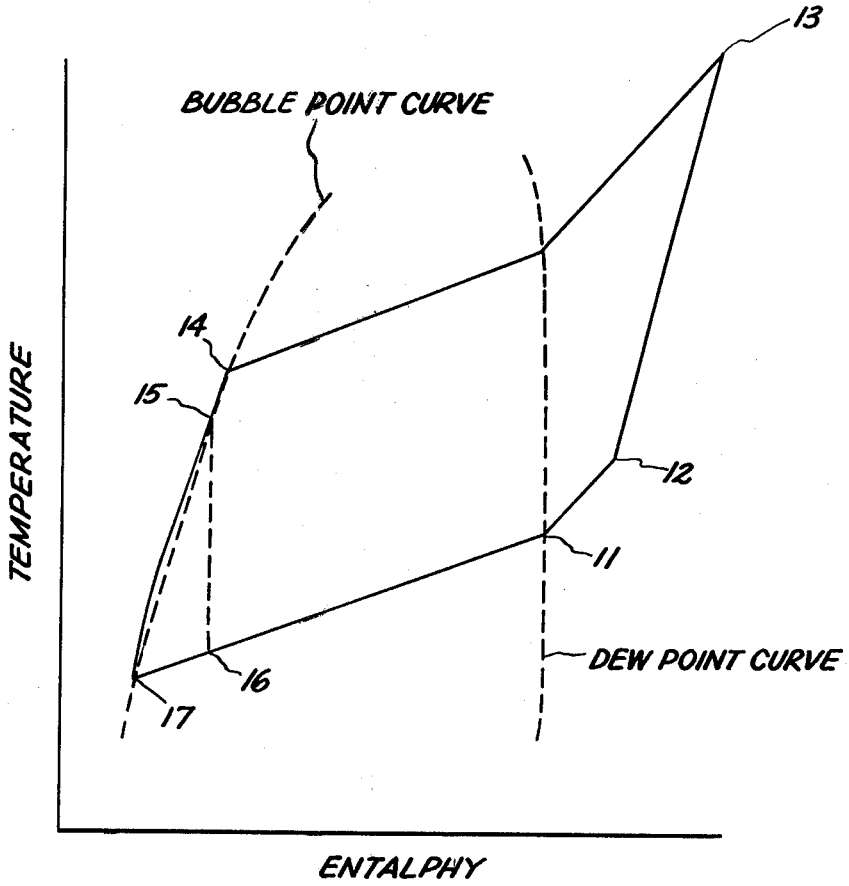
FIG. 4 is a temperature-enthalpy diagram of the thermodynamic cycle of the embodiment depicted in FIG. 2.

FIG. 4 is a typical temperature-enthalpy diagram for the embodiment of the invention illustrated in FIG. 2, which diagram graphically illustrates the effect of the present invention on a thermodynamic cycle. Thus, working fluid vapor is superheated in the suction line 5 from a point 11 to a point 12, and is further heated in the compressor 4 from point 12 to 13. The superheated vapor is cooled and subsequently condensed from point 13 to point 14 in the condensing heat exchanger 6. The fluid is further cooled from the point 14 to 15 by heat transfer with the fluid in the suction line 5. Typically, the working fluid would then be flashed from point 15 to 16 in a conventional device as it is in the device described by Stoecker.

In contrast, the present invention maintains fluid in a liquid-phase while further cooling it from point 15 to 17 through a countercurrent exchange of heat with fluid undergoing evaporation in the evaporator assembly 1. The mixture is then evaporated as from point 17 to 11. The portion of the diagram from point 17 to 16 represents the beneficial extension of the evaporator duty to a lower temperature which is made available by the practice of the present invention.

This extension of evaporator duty corresponds to an increase in cycle efficiency not available in conventional devices. As can be appreciated from FIG. 4, this extension of evaporation duty in the present invention is achieved in part by exploiting the well-known nonisothermal evaporation characteristics of miscible multiple component working fluids. Thus, this present invention can be beneficially employed in conjunction with other vapor compression cycle devices employing multiple-component working fluid mixtures such as the device disclosed in U.S. Pat. No. 4,179,898 of the present inventor.

The above-described embodiments of this invention are intended to be exemplative only and not limiting, and will be appreciated from the foregoing by those skilled in the art that many substitutions, alterations and changes may be made to the disclosed structure without departing from the spirit and scope of the invention. In particular, the present invention is not dependent on the particular design of the heat transfer passage 8 or the evaporator assembly 1.

What is claimed as new and desired to be secured by Letters Patent of the United States is:

1. A method for the recovery of expansion work in a vapor compression cycle device employing a multiple component miscible working fluid mixture and including an evaporator assembly having a coldest portion and a warmest portion, said method comprising the steps of:

transferring mixture vapor from said evaporator assembly and compressing said vapor condensing at least a portion of said compressed vapor conveying condensed mixture through a heat transfer passage to the coldest portion of said evaporator assembly, maintaining the mixture in a liquid phase during substantially all of said conveyance, and removing heat from the mixture during said conveyance evaporating at least a portion of said conveyed mixture while conducting said conveyed mixture from a point adjacent said coldest portion towards said warmest portion of said evaporator assembly in a countercurrent heat exchange relationship with the mixture conveyed through said heat transfer passage whereby at least a portion of the heat removed from said conveyed mixture is added to said evaporating mixture.

2. A method for the recovery of expansion work as in claim 1 wherein said conveyed mixture is conducted through said evaporator assembly from a point adjacent said coldest portion to a point adjacent said warmest portion in a countercurrent heat exchange relationship with the mixture conveyed through said heat transfer passage.

3. A method for the recovery of expansion work as in claim 1 or 2 in which substantially all of the heat removed from the mixture while being conveyed through said heat transfer passage is added to the mixture conducted in countercurrent heat exchange relationship through said evaporator assembly.

4. A method for the recovery of expansion work as in claim 1 wherein at least a portion of the heat removed from the mixture while being conveyed through said heat transfer passage is added to said mixture vapor being transferred from said evaporator assembly.

5. A means for the recovery of expansion work in a vapor compression cycle device employing a multiple component miscible working fluid mixture and having a condensing heat exchanger in flow communication with an outlet of a compressor, said compressor including a suction line, said means comprising:

an evaporator assembly having a warmest portion and a coldest portion and including a flow path extending from said coldest portion to said warmest portion, said flow path being disposed in flow communication with said suction line; and a means for conveying a restricted flow of mixture from said condensing heat exchanger to said evaporator assembly flow path, said conveying means including a heat transfer passage having at least a portion disposed in a countercurrent heat exchange relationship with at least a portion of said flow path extending from a point adjacent said coldest portion.

6. A means for the recovery of expansion work as in claim 5 wherein external surfaces of said evaporator assembly and of said heat transfer passage are in thermal contact.

7. A means for the recovery of expansion work as in claim 5 wherein at least a portion of said heat transfer passage is disposed within said evaporator assembly flow path.

8. A means for recovery of expansion work as in claim 5 wherein said evaporator assembly flow path is disposed in countercurrent heat exchange relationship for substantially all of the length of said flow path with at least a portion of said heat transfer passage.

9. A means for the recovery of expansion work as in claim 5 wherein said evaporator assembly flow path and said heat transfer passage are disposed in a countercurrent heat exchange relationship for substantially all of their respective lengths.

10. A means for the recovery of expansion work as in claim 5 wherein at least a portion of said conveying means is disposed in heat exchange relationship with at least a portion of said compressor suction line.

11. A means for the recovery of expansion work as in claim 5 wherein substantially all of said heat transfer passage is in countercurrent heat exchange relationship with a segment of said vapor compression cycle device comprising substantially all of said evaporator assembly flow path and at least a portion of said compressor suction line.

12. A means for the recovery of expansion work as in claim 5 wherein said conveying means comprises a capillary tube.

13. A means for the recovery of expansion work as in claim 5 wherein at least a portion of said evaporator assembly and of said heat transfer passage are disposed in thermal contact along opposite sides of a common heat transfer wall in a monolithic heat exchange device.

* * * * *